US009022110B2

(12) United States Patent
Pei et al.

(10) Patent No.: US 9,022,110 B2
(45) Date of Patent: May 5, 2015

(54) SEGMENTAL FLOW-CONTROL METHOD FOR FLOW-CONTROL FILTER STRING IN OIL-GAS WELL AND OIL-GAS WELL STRUCTURE

(75) Inventors: Bailin Pei, Beijing (CN); Yong Xue, Beijing (CN)

(73) Assignee: Anton Bailin Oilfield Technologies Co., Ltd., Beijing (CN)

( * ) Notice: Subject to any disclaimer, the term of this patent is extended or adjusted under 35 U.S.C. 154(b) by 374 days.

(21) Appl. No.: 13/514,746

(22) PCT Filed: Dec. 10, 2010

(86) PCT No.: PCT/CN2010/002017

§ 371 (c)(1),
(2), (4) Date: Jul. 10, 2012

(87) PCT Pub. No.: WO2011/069342

PCT Pub. Date: Jun. 16, 2011

(65) Prior Publication Data

US 2012/0267100 A1 Oct. 25, 2012

(30) Foreign Application Priority Data

Dec. 11, 2009 (CN) ..... 2009 1 0250790

(51) Int. Cl.
*E21B 33/138* (2006.01)
*E21B 33/14* (2006.01)
(Continued)

(52) U.S. Cl.
CPC ..... *E21B 33/138* (2013.01); *E21B 33/14* (2013.01); *E21B 33/124* (2013.01); *E21B 43/08* (2013.01); *E21B 43/12* (2013.01)

(58) Field of Classification Search
CPC ..... E21B 33/138; E21B 33/14
USPC ..... 166/276, 277, 278, 292, 51, 177.4
See application file for complete search history.

(56) References Cited

U.S. PATENT DOCUMENTS 2,187,275 A * 1/1940 McLennan ..... 166/113
2,451,520 A * 10/1948 Teplitz ..... 166/253.1
(Continued)

FOREIGN PATENT DOCUMENTS

CN 101338660 1/2009
CN 101372889 2/2009
(Continued)

*Primary Examiner* — Jennifer H Gay
(74) *Attorney, Agent, or Firm* — Scheinberg & Associates, PC; Michael O. Scheinberg; John B. Kelly

(57) ABSTRACT

A segmental flow-control method for a flow-control filter string in an oil-gas well and an oil-gas well structure are disclosed. The oil-gas well includes a well wall(1), a casing (2) located in the well wall(1), a cement sheath(3) provided between the casing(2) and the well wall(1), channeling path (5) existing outside the casing(2), and a plurality of perforated tunnels (6) passing through the casing(2), the cement sheath (3) and/or the channeling path(5) and into a formation from the inside of the casing to the formation. The segmental flow-control method for the flow-control filter string(7) includes the following steps: running the flow-control filter string(7) into the casing, wherein the flow-control filter string (7) is provided with a flow-control filter (8), and an annular space is at least partially formed between the flow-control filter string(7) and the casing(2); injecting a particle-carrying liquid carrying anti-channeling flow pack-off particles into the annular space through a particle-carrying liquid injecting passage, thus the particle-carrying liquid carries the anti-channeling flow pack-off particles into the annular space, and enters the channeling path(5) through the perforated tunnels (6); and sealing the particle-carrying liquid injecting passage or closing a communicating part between the particle-carrying liquid injecting passage and the annular space.

29 Claims, 4 Drawing Sheets

(51) Int. Cl.

| | |
|---|---|
| ***E21B 43/12*** | (2006.01) |
| *E21B 33/124* | (2006.01) |
| *E21B 43/08* | (2006.01) |

(56) References Cited

U.S. PATENT DOCUMENTS

| | | | | | |
|---|---|---|---|---|---|
| 2,842,205 | A * | 7/1958 | Allen et al. | 166/285 |
| 3,967,681 | A * | 7/1976 | Curzon | 166/277 |
| 4,589,490 | A * | 5/1986 | Darr et al. | 166/276 |
| 4,627,496 | A * | 12/1986 | Ashford et al. | 166/292 |
| 5,106,423 | A * | 4/1992 | Clarke | 106/789 |
| 5,127,473 | A * | 7/1992 | Harris et al. | 166/277 |
| 5,131,473 | A * | 7/1992 | Fischer | 166/373 |
| 5,332,037 | A * | 7/1994 | Schmidt et al. | 166/276 |
| 5,346,012 | A * | 9/1994 | Heathman et al. | 166/293 |
| 5,383,521 | A * | 1/1995 | Onan et al. | 166/293 |
| 5,404,951 | A * | 4/1995 | Lai et al. | 166/295 |
| 5,531,272 | A * | 7/1996 | Ng et al. | 166/277 |
| 5,950,727 | A * | 9/1999 | Irani | 166/270 |
| 6,450,260 | B1 * | 9/2002 | James et al. | 166/277 |
| 7,673,686 | B2 * | 3/2010 | Nguyen et al. | 166/281 |
| 8,726,992 | B2 * | 5/2014 | Freyer | 166/285 |
| 2003/0075315 | A1 * | 4/2003 | Nguyen et al. | 166/51 |
| 2004/0251033 | A1 * | 12/2004 | Cameron et al. | 166/382 |
| 2005/0056425 | A1 | 3/2005 | Grigsby et al. | |
| 2006/0201673 | A1 * | 9/2006 | Welton et al. | 166/280.2 |
| 2008/0000636 | A1 * | 1/2008 | Misselbrook | 166/276 |
| 2008/0230223 | A1 * | 9/2008 | McCrary et al. | 166/272.2 |
| 2009/0188569 | A1 | 7/2009 | Saltel | |
| 2010/0065271 | A1 * | 3/2010 | McCrary et al. | 166/278 |
| 2010/0200233 | A1 * | 8/2010 | Yeh et al. | 166/276 |
| 2011/0030952 | A1 * | 2/2011 | Huang et al. | 166/278 |
| 2012/0000651 | A1 * | 1/2012 | Panga et al. | 166/278 |
| 2012/0217010 | A1 * | 8/2012 | Haeberle et al. | 166/278 |
| 2012/0247762 | A1 * | 10/2012 | Pei et al. | 166/278 |
| 2012/0267100 | A1 * | 10/2012 | Pei et al. | 166/278 |
| 2012/0279716 | A1 * | 11/2012 | Pei et al. | 166/311 |

FOREIGN PATENT DOCUMENTS

| | | | |
|---|---|---|---|
| CN | 101463719 | | 6/2009 |
| CN | 201254976 | Y | 6/2009 |
| CN | 101705808 | | 5/2010 |
| CN | 101705809 | | 5/2010 |
| CN | 101705810 | | 5/2010 |
| WO | 2005078235 | | 8/2005 |
| WO | 2007140820 | | 12/2007 |

* cited by examiner

SEGMENTAL FLOW-CONTROL METHOD FOR FLOW-CONTROL FILTER STRING IN OIL-GAS WELL AND OIL-GAS WELL STRUCTURE

TECHNICAL FIELD

The present invention relates to a segmental flow-control method for a flow-control filter string in an oil-gas well and an oil-gas well structure, and particularly to a segmental flow-control method for a flow-control filter string in an oil-gas well with a channeling path existing outside a casing and a structure of the oil-gas well. An oil-gas well here refers to a production well in a broad sense in oil-gas development, including an oil well, a gas well, natural gas well, an injection well or the like.

BACKGROUND ART

During production of an oil-gas well, no matter whether it is a vertical well, an inclined well or a horizontal well, due to factors such as heterogeneity of oil reservoir, the oil-gas well needs to be packed off into a plurality of relatively independent zones for production. The oil-gas well production here comprises output and injection of oil-gas well fluids, such as petroleum exploitation, or injection of water, gas, chemical agents for improving a recovery rate of oil field, or the like, into the formation during production, or injection of acid liquids into the formation during some operations.

The oil-gas well is packed off into a plurality of relatively independent zones for production usually by a method of using a segmental flow-control device in combination with devices for separating the production segment of the oil-gas well into several flow units in an axial direction of the oil-gas well, for example, by a method of using a flow-control filter string plus a packer.

As we know, in the oil-gas well into which a casing is already run, an annular space is present between the casing and the well wall. If the annular space is not effectively packed off, formation fluid penetrating into the annular space will form an axial channeling flow in the annular space (those skilled in the art can all appreciate that the casing in an oil-gas well structure generally comprises a production-segment casing mainly located in a production formation, a surface casing adjacent to a well mouth and a technical casing therebetween. These kinds of casing are generally collectively called casing by those skilled in the art, and usually will not be particularly distinguished upon description because those skilled in the art all clearly understand that which segment of casing, which two segments of casing, all segments of casing or which one corresponding portion thereof the term "casing" used in a textual context specifically refers to.) In order to avoid the axial channeling flow of the formation fluid in the annular space between the casing and the well wall, currently cement is injected in to seal the annular space. This operation is briefly called well cementation.

A main purpose of well cementing operation is to prevent axial channeling flow of formation fluid in the annular space outside the casing during production.

There are many causes which may lead to undesirable quality of well cementing in the oil-gas well so that channels through which fluid can flow are present outside the casing. For example, as far as a horizontal well is concerned, one important reason for undesirable quality of well cementing is that cement slurry sinks during well cementation so that a vacancy appears in an upper portion of a cement sheath, thereby forming channeling flow passages. Existence of the channeling flow passages seriously affects the cement pack-off effect. Particularly, in the present invention, the vacancy which is outside the casing and may cause channeling is called a channeling path, which includes but not limited to one or more of vacancies not yet filled with cement outside the casing, vacancies formed by collapsing or sinking on the cement sheath (mainly when cement is not yet solidified), vacancies formed by deformation of the casing or cement sheath due to factors such as earth stress, and other vacancies which are between the casing and the well wall and may cause channeling.

FIG. 1 shows an oil-gas structure with a channeling path existing outside the casing, comprising a well wall 1, a casing 2, a cement sheath 3 provided between the casing and the well wall, a hold-down packer 4 for hanging the casing, a channeling path 5, and a plurality of perforated tunnels 6. As shown in FIG. 1, if there exists formation water-out at the perforated tunnel 6-1, water will flow into the perforated tunnel 6-1 in a direction indicated by the arrow. After passing through part of the perforated tunnel 6-1, water enters the channeling path 5, then flows in the channeling path in a direction indicated by the arrow to the perforated tunnel 6-2, flows into the casing 2 through the perforated tunnel 6-2 and thereby ruins the pack-off effect of the cement sheath.

As shown in FIG. 2, flow control is implemented by a method of running a flow-control filter string 7 into the casing by a run-in string, a hold-down packer 9 for hanging the flow-control filter string is provided at an upper portion of the flow-control filter string (e.g., those skilled in the art can appreciate that the "upper portion" of the flow-control filter string in the text refers to an end of the flow-control filter string adjacent to the borehole mouth), flow-control filters 8 are provided on the flow-control filter string, and then packers 10 are used to segment and pack off the annular space between the flow-control filter string and the casing. Due to existence of the perforations and channeling path, as shown in FIG. 2, if water appears at the perforated tunnel 6-1, the formation water, after passing through the perforated tunnel 6-1, enters the channeling path 5 and forms an axial flow in the channeling path, the water flows to the perforated tunnel 6-2, flows into the casing 2 through the perforated tunnel 6-2, the water comes to a flow-control filter 8-1 and a flow-control filter 8-2 in the casing and enters the casing through the flow-control filter 8-1 and the flow-control filter 8-2, and thereby ruins the pack-off effect of the packers 10.

Therefore, the segmental flow-control method as substantially used currently and implemented by the packers plus the flow-control filter string is not adapted for oil-gas wells with a channeling path existing outside the casing.

SUMMARY OF THE INVENTION

An object of the present invention is to overcome the defect that in the prior art it is difficult to achieve segmental flow control in an oil-gas well with a channeling path existing outside a casing, and to provide a segmental flow-control method for the flow-control filter string adapted for the oil-gas well with the channeling path existing outside the casing. Generally speaking, the present invention uses the property that anti-channeling flow pack-off particles can be easily moved at a low flow rate, so that the anti-channeling flow pack-off particles can easily fully stuff the channeling path outside the casing, not only substantially limiting the channeling flow in the channeling path, but also substantially limiting the channeling flow in an annular space between the flow-control filter string and the casing, and realizing the purpose of carrying out segmental flow control for the flow-control filter string in the oil-gas well with the channeling path existing outside the casing.

Specifically, in one aspect, the present invention provides a segmental flow-control method for a flow-control filter string in an oil-gas well which comprises a well wall, a casing located in the well wall, a cement sheath provided between the casing and the well wall, and a channeling path existing outside the casing, wherein a plurality of perforated tunnels pass through the casing, the cement sheath and/or the channeling path and into a formation from the inside of the casing to the formation. The segmental flow-control method for the flow-control filter string includes the following steps:

Step 1: running the flow-control filter string into the casing, wherein the flow-control filter string is provided with a flow-control filter, and an annular space is at least partially formed between the flow-control filter string and the casing;

Step 2: injecting a particle-carrying liquid carrying anti-channeling flow pack-off particles into the annular space through a particle-carrying liquid injecting passage, thus the particle-carrying liquid carries the anti-channeling flow pack-off particles into the annular space, and enters the channeling path through the perforated tunnels; and Step 3: sealing the particle-carrying liquid injecting passage or closing a communicating part between the particle-carrying liquid injecting passage and the annular space.

Preferably, the flow-control filter string is run into the casing by means of a run-in string. In this case, the segmental flow-control method for the flow-control filter string further comprises: after step 3, disconnecting the run-in string connected to the flow-control filter string so as to form a completion well structure wherein the annular space and the channeling path is filled with the anti-channeling flow pack-off particles.

In another aspect, the present invention further provides an oil-gas well structure, comprising: a well wall, a casing located in the well wall, a cement sheath provided between the casing and the well wall, and channeling path existing outside the casing, wherein a plurality of perforated tunnels pass through the casing, the cement sheath and/or the channeling path and into a formation from the inside of the casing to the formation; the flow-control filter string is run into the casing, the flow-control filter string is provided with flow-control filters, and an annular space between the flow-control filter string and the casing as well as the channeling path outside the casing are filled with the anti-channeling flow pack-off particles.

The oil-gas well structure according to the present invention is preferably implemented by the segmental flow-control method for the flow-control filter string according to the present invention.

In a yet another aspect, the present invention also provides a segmental flow-control method for a flow-control filter string in an oil-gas well with a channeling path existing outside a casing, wherein the oil-gas well with the channeling path existing outside the casing comprises a well wall, a casing being already run into the oil-gas well, a cement sheath being provided between the casing and the well wall, and the channeling flow passage formed by a vacancy not filled with cement outside the casing being called as the channeling path in this aspect, wherein a plurality of perforated tunnels pass through the casing, the cement sheath and the channeling path and into a formation from the inside of the casing to the formation; the segmental flow-control method for the flow-control filter string includes the following steps:

1) running the flow-control filter string into the casing by means of a run-in string, wherein the flow-control filter string is provided with a flow-control filter, and an annular space is formed between the flow-control filter string and the casing;

2) injecting the particle-carrying liquid carrying the anti-channeling flow pack-off particles into the annular space between the flow-control filter string and the casing; the particle-carrying liquid carries the anti-channeling flow pack-off particles into the annular space between the flow-control filter string and the casing, and into the channeling path outside the casing via the perforated tunnels; and the anti-channeling flow pack-off particles simultaneously fill, accumulate in and fully stuff the annular space between the flow-control filter string and the casing as well as the channeling path outside the casing.

3) sealing the annular space between the upper portion of the flow-control filter string and the casing;

4) disconnecting the run-in string connected to the flow-control filter string, thereby forming a completion well structure wherein both the annular space between the flow-control filter string and the casing and the channeling path outside the casing are fully stuffed with the anti-channeling flow pack-off particles.

Similarly, those skilled in the art can all appreciate that this method according to the present invention can be used to form an oil-gas well having a corresponding structure.

In embodiments according to the respective aspects of the present invention, preferably, the anti-channeling flow pack-off particles entering the annular space and the channeling path fill, accumulate in and fully stuff the annular space and the channeling path.

In embodiments according to the respective aspects of the present invention, preferably, the particle-carrying liquid injecting passage is the annular space between the upper portion of the flow-control filter string and the corresponding casing.

In embodiments according to the respective aspects of the present invention, preferably, a packer is provided above the flow-control filter string for hanging the flow-control filter string, the particle-carrying liquid injecting passage is a passage which is in the packer or around the packer and not sealed when injecting the particle-carrying liquid so as to allow the particle-carrying liquid to flow therethrough.

In embodiments according to the respective aspects of the present invention, preferably, a true particle density of the anti-channeling flow pack-off particles is close to a density of the particle-carrying liquid so that the anti-channeling flow pack-off particles are adapted to be carried by the particle-carrying liquid into the channeling path.

In embodiments according to the respective aspects of the present invention, preferably, a true particle density of the anti-channeling flow pack-off particles is any value in a range of 0.4 $g/cm^3$ greater than or less than the density of the particle-carrying liquid.

In embodiments according to the respective aspects of the present invention, preferably, the true particle density of the anti-channeling flow pack-off particles is any value in a range of 0.2 $g/cm^3$ greater than or less than the density of the particle-carrying liquid.

In embodiments according to the respective aspects of the present invention, preferably, the particle-carrying liquid carrying the anti-channeling flow pack-off particles is water or aqueous solution.

In embodiments according to the respective aspects of the present invention, preferably, the anti-channeling flow pack-off particles comprise macromolecular polymer particles having an average particle diameter of 0.05-1.0 mm and a true particle density of 0.8-1.4 $g/cm^3$.

In embodiments according to the respective aspects of the present invention, preferably, the anti-channeling flow pack-off particles comprise macromolecular polymer particles having an average particle diameter of 0.1-0.5 mm and a true particle density of 0.94-1.06 g/cm$^3$.

In embodiments according to the respective aspects of the present invention, preferably, the anti-channeling flow pack-off particles comprise high-density polyethylene particles having an average particle diameter of 0.1-0.5 mm and a true particle density of 0.90-0.98 g/cm$^3$.

In embodiments according to the respective aspects of the present invention, preferably, the anti-channeling flow pack-off particles comprise styrene divinylbenzene crosslink copolymer particles having an average particle diameter of 0.05-1.0 mm and a true particle density of 0.96-1.06 g/cm$^3$.

In embodiments according to the respective aspects of the present invention, preferably, the anti-channeling flow pack-off particles comprise polypropylene and polyvinyl chloride macromolecular polymer particles having an average particle diameter of 0.05-1.0 mm and a true particle density of 0.8-1.2 g/cm$^3$.

Here, it should be particularly noted that the term "true particle density" used in the present invention is an actual density of a single particle itself rather than a particle packing density as measured from a lot of pile-up particles, which can be clearly understood by those skilled in the art.

The present invention preferably uses water or an aqueous solution with a density of approximately 1.0 g/cm$^3$ as the particle-carrying liquid carrying the anti-channeling flow pack-off particles. In the present invention, the anti-channeling flow pack-off particles having the true particle density close to the density of the particle-carrying liquid are particularly selected so that the particle-carrying liquid can very easily carry the anti-channeling flow pack-off particles to fill the annular space between the flow-control filter string and the casing as well as the channeling path outside the casing, and the anti-channeling flow pack-off particles fill, accumulate in and fully stuff the annular space between the flow-control filter string and the casing as well as the channeling path outside the casing. Thereafter, a portion of the particle-carrying liquid enters the flow-control filter string and returns to the ground, and another portion of the particle-carrying liquid permeates into the formation through the well wall. Finally, there is formed a completion well structure in which the annular space between the flow-control filter string and the casing as well as the channeling path outside the casing are fully stuffed with the anti-channeling flow pack-off particles. The anti-channeling flow pack-off particles fill compactly so that there are substantially no channeling paths. The oil-gas well can be effectively packed off into a plurality of relatively independent zones for production in combination with the flow-control filter string, thereby achieving segmental flow control, facilitating segmental management of flow and bringing about good effects to production of the oil-gas well, such as improving the oil output and the recovery rate of the oil-gas well.

Moreover, even if the channeling path and the annular space between the flow-control filter string and the casing are filled not compactly enough, during production axial channeling flow of a very small amount of liquid in production will bring the anti-channeling flow pack-off particles to move to accumulate in the direction of the channeling flow and fully stuff the channeling path and the annular space between the flow-control filter string and the casing, thereby achieving an excellent anti-channeling flow pack-off effect and achieving the segmental flow control for the flow-control filter string in combination with the flow-control filter string.

Flowing of the formation fluid in a medium formed by piling up anti-channeling flow pack-off particles is a seepage flow. According to principles of fluid mechanics in porous medium, a magnitude of a seepage resistance is directly proportional to a seepage distance and inversely proportional to a seepage area. Since the anti-channeling flow pack-off particles in the annular space and the channeling path are piled up with a small thickness, a small section and a large axial length, the channeling flow of the formation fluid in the anti-channeling flow pack-off particles in the axial direction of the oil-gas well meets a very large flow resistance whereas the flow in a radial direction of the oil-gas well meets a very small flow resistance because the flow area is large and flow distance is short. The flow resistance when flowing several meters to tens of meters in the axial direction of the oil-gas well is hundreds of even thousands of times greater than the flow resistance when flowing several centimeters in the radial direction of the oil-gas well. The substantial difference between the flow resistance in the axial direction and the radial direction of the oil-gas well causes the flow in the axial direction of the oil-gas well to be by far smaller than the flow in the radial direction of the oil-gas well under the same pressure differential. Such discrepancy of flow resistance of the pile of anti-channeling flow pack-off particles in the axial direction and radial direction can ensure smooth flow of the formation fluid in the radial direction of the oil-gas well and meanwhile limit the flow of the formation fluid in the axial direction of the oil-gas well, thereby functioning as a packer.

The present invention provides a convenient and practical segmental flow-control method for the flow-control filter string in an oil-gas well with the channeling path existing outside the casing. Meanwhile, the method can achieve pack-off of the annular space between the flow-control filter string and the casing as well as the channeling path outside the casing, achieve a good pack-off effect and very well achieve segmental flow control, improve the production efficiency of the oil field and meet actual oil field production requirements in combination with the flow-control filter string.

The method according to the present invention is simple and practical. The anti-channeling flow pack-off particles are compactly filled to achieve an excellent pack-off effect and accomplish excellent segmental flow control in combination with the flow-control filter string.

DETAILED DESCRIPTION OF THE PREFERRED EMBODIMENTS

Figure 1:
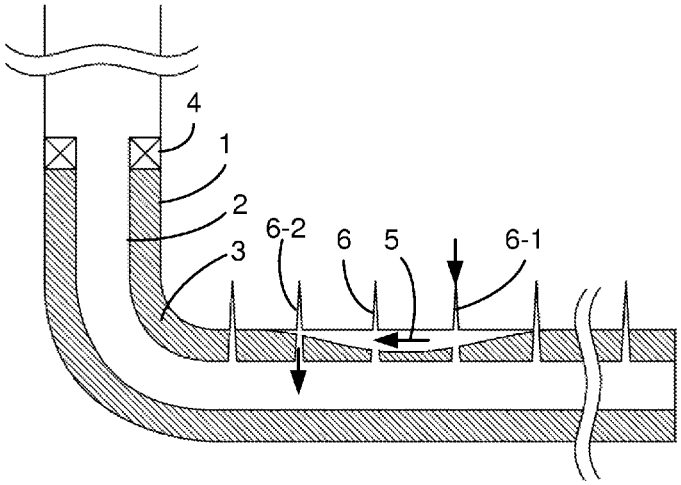
FIG. 1 (prior art)
FIG. 1 is a structural schematic view of a channeling path in a cement sheath in a perforated well according to the prior art.
Figure 2:
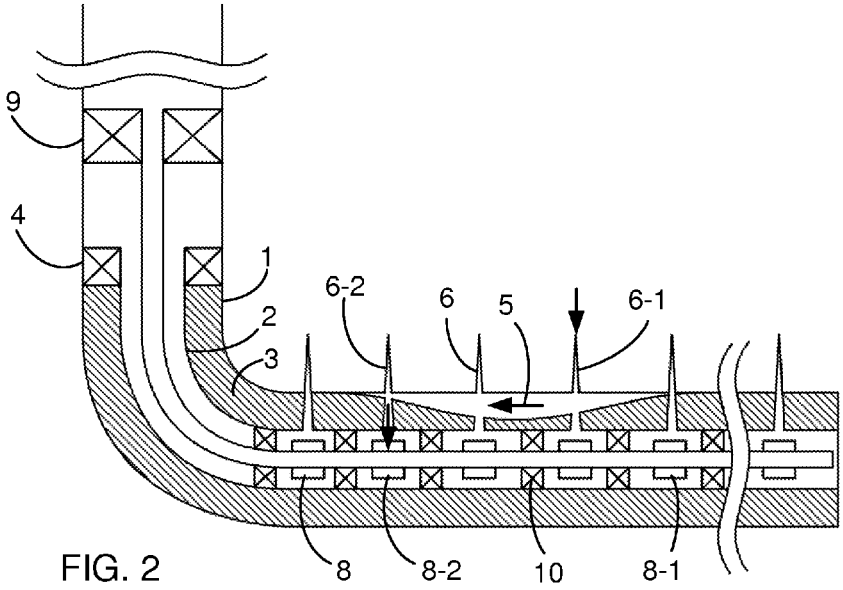
FIG. 2 (prior art)
FIG. 2 is a schematic view of the channeling path in a cement sheath in a perforated well according to the prior art ruining flow control by a flow-control filter string plus packers.
Figure 3:
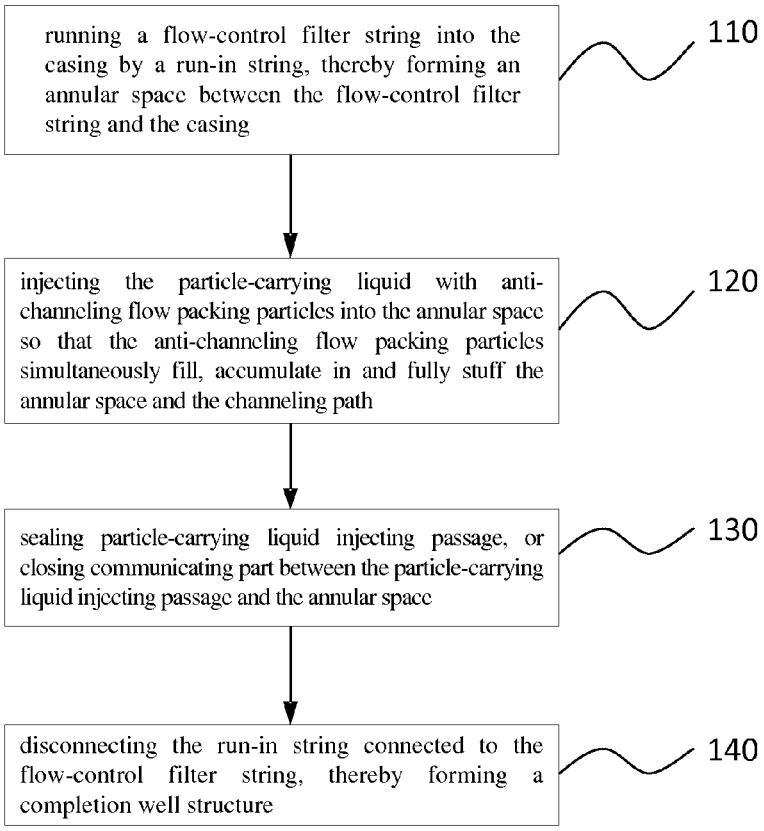
FIG. 3 is an illustrative flowchart of a segmental flow-control method for the flow-control filter string in an oil-gas well having the channeling path outside a casing according to an embodiment of the present invention.

FIG. 3 shows an illustrative flowchart of a segmental flow-control method for the flow-control filter string in an oil-gas well with a channeling path existing outside a casing according to a preferred embodiment of the present invention, and the pack-off method comprises the following steps:

Step 110: running a flow-control filter string 7 into a casing 2 of the production segment preferably by means of a run-in string (the run-in string per se is well known by those skilled in the art and not shown in the drawings), wherein the flow-control filter string 7 is provided with flow-control filters 8, and an annular space is at least partially formed between the flow-control filter string 7 and the casing 2.

Figure 4:
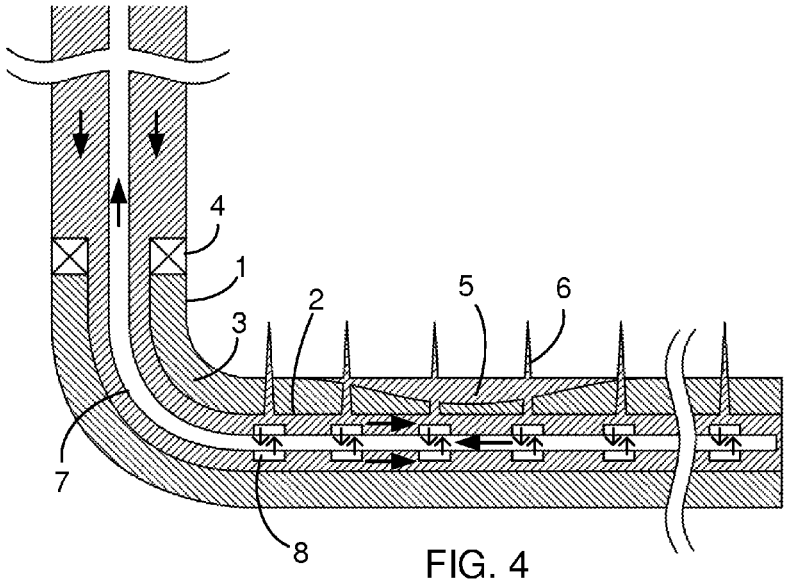
FIG. 4 is a schematic view showing flow of a particle-carrying liquid when filling anti-channeling flow pack-off particles during implementing the segmental flow-control method for the flow-control filter string in the oil-gas well with the channeling path existing outside the casing according to a preferred embodiment of the present invention.
Figure 6:
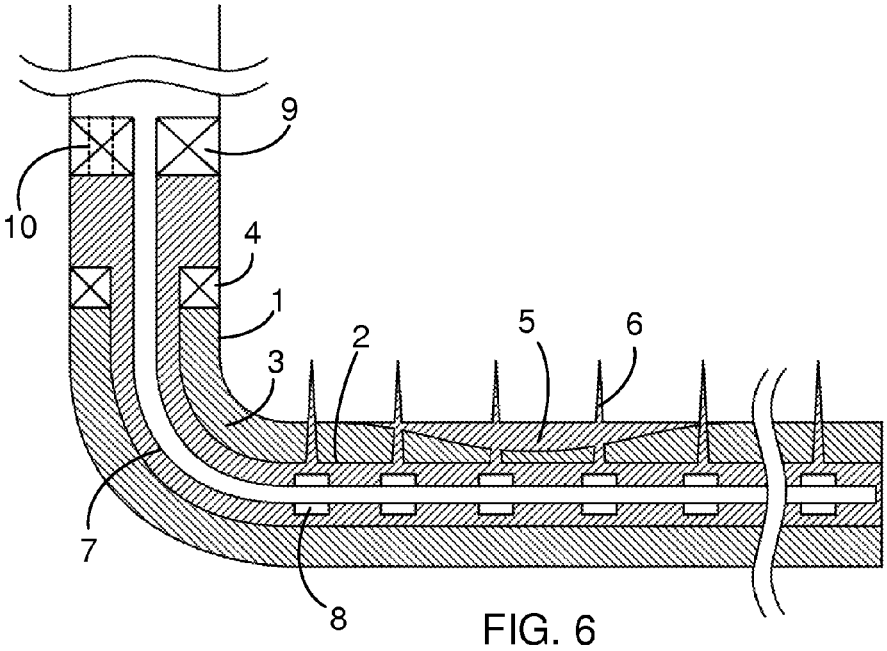
FIG. 6 is a schematic view showing a packer having a particle-carrying, liquid injection passage that can be used for anti-channeling flow pack-off particles during implementing the segmental flow-control method for the flow-control filter string in the oil-gas well with the channeling path existing outside the casing according to an alternative embodiment of the present invention.

Step 120: injecting a particle-carrying liquid carrying anti-channeling flow pack-off particles into the annular space between the flow-control filter string 7 and the casing 2 through a particle-carrying liquid injection passage. For example, the particle-carrying liquid injection passage may be an annular space between an upper portion of the flow-control filter string 7 and the corresponding casing (those skilled in the art can all appreciate that under the circumstance shown in the figure, the casing constituting the particle-carrying liquid injection passage together with the upper portion of the flow-control filter string 7 is a casing located above the production-segment casing hanged by a packer 4. Certainly, those skilled in the art can appreciate that if the flow-control filter string 7 does not extend upwardly out of the production-segment casing, the casing constituting the particle-carrying liquid injection passage together with the upper portion of the flow-control filter string 7 is a production-segment casing.) Alternatively, under the circumstance that a packer 9 is provided above the flow-control filter string 7 for hanging the flow-control filter string, the particle-carrying liquid injection passage for example may be a passage 10, as shown in FIG. 6, which is in the packer 9 or around it and not sealed when injecting the particle-carrying liquid so as to allow the particle-carrying liquid to flow therethrough. Those skilled in the art all appreciate that the particle-carrying liquid injection passage may also be any other passages or injection ports which are adapted to inject the particle-carrying liquid into the annular space between the filter string and the casing. The particle-carrying liquid carries the anti-channeling flow pack-off particles into the annular space between the flow-control filter string and the casing, and enters the channeling path 5 outside the casing 2 through the casing 2, the cement sheath 3 and the perforated tunnels 6 of the channeling path 5. The anti-channeling flow pack-off particles fill, accumulate in and preferably fully stuff the annular space between the flow-control filter string and the casing and the as well as the channeling path 5. A portion of particle-carrying liquid wherein the anti-channeling flow pack-off particles are filtered enters the flow-control filter string and returns to the ground, and another portion of the particle-carrying liquid permeates into the formation through the well wall; the arrows in FIG. 4 show a flow direction of the particle-carrying liquid. A true particle density of the anti-channeling flow pack-off particles is preferably close to a density of the particle-carrying liquid so that the anti-channeling flow pack-off particles are adapted to be carried by the particle-carrying liquid into the channeling path. For example, the true particle density of the anti-channeling flow pack-off particles can be any value in a range of 0.4 g/cm$^3$ greater than or less than a density of the particle-carrying liquid, preferably any value in a range of 0.2 g/cm$^3$ greater than or less than the density of the particle-carrying liquid. Furthermore, the particle-carrying liquid may preferably be water or aqueous solution. A density of water or aqueous solution is generally about 1.0 g/cm$^3$.

Step 130: sealing the particle-carrying liquid injection passage or closing a communicating portion between the particle-carrying liquid injection passage and the annular space. For example, by setting the packer 9 hanging the flow-control filter string, the annular space between the upper portion of the flow-control filter string and the corresponding casing may be completely sealed (the packer 9 not yet set is not shown in FIG. 4, but those skilled in the art all appreciate that the packer 9 not yet set may exist in FIG. 4 and it may be located around the filter string at the same position as the packer 9 in FIG. 5. However, different from FIG. 5, an annular space exists between an outer circumference of the packer 9 in the state shown in FIG. 4 and the corresponding casing because the packer 9 is not yet set.), that is, a passageway which is between the circumference of the packer 9 and the casing and allows the particle-carrying liquid to pass therethrough. Again for example, if the injection passage operably allowing the particle-carrying liquid to pass therethrough is configured in the packer 9, the packer 9 is disposed and set after the flow-control filter string 7 is run, and the particle-carrying liquid may enter the annular space between the filter string and the casing as well as the channeling path through the injection passage in the packer 9; after completion of injection, the injection passage in the packer 9 may be closed by actuating a movable part in the packer 9 or using an additional mechanism.

Figure 5:
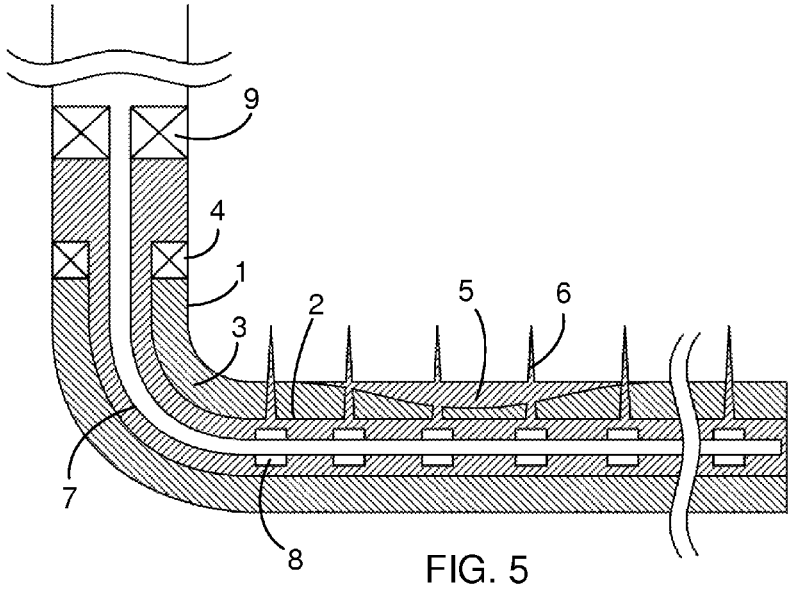
FIG. 5 is a schematic view of a completion well structure by the segmental flow-control method for the flow-control filter string according to a preferred embodiment of the present invention in the oil-gas well with the channeling path existing outside the casing.

Step 140: in this case where the flow-control filter string 7 is run by means of a run-in string, the run-in string connected to the flow-control filter string should be disconnected at this time so as to form a completion well structure wherein the annular space between the flow-control filter string and the casing as well as the channeling path outside the casing are preferably fully stuffed with the anti-channeling flow pack-off particles, as shown in FIG. 5. Those skilled in the art can appreciate that when other running-in methods or devices currently known or to be known in the future are employed, step 140 may not be requisite.

In the present embodiment, the anti-channeling flow pack-off particles preferably comprise high-density polyethylene particles having an average particle diameter of 0.1-0.5 mm and a true particle density of 0.90-0.98 g/cm$^3$.

In another preferred embodiment according to the present invention, the anti-channeling flow pack-off particles comprise styrene divinylbenzene crosslink copolymer particles having an average particle diameter of 0.05-1.0 mm (e.g., 0.1-0.5 mm) and a true particle density of 0.96-1.06 g/cm$^3$.

In a yet another preferred embodiment according to the present invention, the anti-channeling flow pack-off particles comprise polypropylene and polyvinyl chloride macromolecular polymer particles having an average particle diameter of 0.05-1.0 mm (e.g., 0.1-0.5 mm) and a true particle density of 0.8-1.2 g/cm$^3$.

The production segment stated in the present invention is a production segment in a broad sense. A length range of the production segment may cover segments in which a fluid cannot flow, such as an interlayer, a sandwich layer, or imperforated segments after casing cementing.

The flow-control filter string in the present invention includes a filtration segment and blank segments which are arranged in an alternate way. The blank segments are pipe segments which wall surface is not perforated. The anti-channeling flow pack-off particles outside the blank segments play a major role of preventing channeling flow in the axial direction. Blank segments are provided from two aspects: one aspect is that each filter in fact comprises a filtration segment and blank segments, wherein the blank segments are located at both ends of the filter and are provided with threads, and when the filter is connected by screwing threadedly 32, the blank segments are to be gripped by pliers; the other aspect is that a blank segment is added between two filters. The anti-channeling flow pack-off particles are preferably circular.

Finally, it should be appreciated that obviously the above embodiments are only examples to make the present invention apparent and are not intended to limit implementation modes. Those skilled in the art apprehend that other variations or modifications in different forms can also made on the basis of the above description, for example, the position and configuration of the particle-carrying liquid injection passage may have various variations. It is unnecessary and incapable herein to list all the implementation modes. Obvious variations and modifications made on the basis of the description still fall within the protection scope of the present invention.

What is claimed is:

1. A segmental flow-control method for a flow-control filter string in an oil-gas well which comprises a well wall, a casing disposed inside the well wall, a cement sheath provided between the casing and the well wall, and a channeling path existing outside the casing, wherein a plurality of perforated tunnels pass through the casing, the cement sheath and the channeling path and into a formation from the inside of the casing to the formation, the segmental flow-control method for the flow-control filter string includes the following steps:

Step 1: running the flow-control filter string into the casing, wherein the flow-control filter string is provided with a flow-control filter, and an annular space is at least partially formed between the flow-control filter string and the casing;

Step 2: injecting a particle-carrying liquid carrying anti-channeling flow pack-off particles into the annular space through a particle-carrying liquid injecting passage, thus the particle-carrying liquid carries the anti-channeling flow pack-off particles into the annular space, and enters the channeling path through the perforated tunnels;

Step 3: sealing the particle-carrying liquid injecting passage or closing a communicating part between the particle-carrying liquid injecting passage and the annular space; and wherein the anti-channeling flow pack-off particles entering the annular space and the channeling path fill, accumulate in and fully stuff the annular space and the channeling path.

2. The segmental flow-control method for the flow-control filter string according to claim 1, wherein a packer is provided above the flow-control filter string for hanging the flow-control filter string, the particle-carrying liquid injecting passage is a passage which is in the packer or around the packer and not sealed when injecting the particle-carrying liquid so as to allow the particle-carrying liquid to flow therethrough.

3. The segmental flow-control method for the flow-control filter string according to claim 1, wherein the flow-control filter string is run into the casing by means of a run-in string, and in this case the segmental flow-control method for the flow-control filter string further comprises: after step 3, disconnecting the run-in string connected to the flow-control filter string so as to form a completion well structure wherein the annular space and the channeling path is filled with the anti-channeling flow pack-off particles.

4. The segmental flow-control method for the flow-control filter string according to claim 1, wherein a true particle density of the anti-channeling flow pack-off particles is close to a density of the particle-carrying liquid so that the anti-channeling flow pack-off particles are adapted to be carried by the particle-carrying liquid into the channeling path.

5. The segmental flow-control method for the flow-control filter string according to claim 1, wherein a true particle density of the anti-channeling flow pack-off particles is any value in a range of 0.4 g/cm$^3$ greater than or less than the density of the particle-carrying liquid.

6. The segmental flow-control method for the flow-control filter string according to claim 5, wherein the true particle density of the anti-channeling flow pack-off particles is any value in a range of 0.2 g/cm$^3$ greater than or less than the density of the particle-carrying liquid.

7. The segmental flow-control method for the flow-control filter string according to claim 1, wherein the particle-carrying liquid carrying the anti-channeling flow pack-off particles is water or aqueous solution.

8. The segmental flow-control method for the flow-control filter string according to claim 1, wherein the anti-channeling flow pack-off particles comprise macromolecular polymer particles having an average particle diameter of 0.05-1.0 mm and a true particle density of 0.8-1.4 g/cm$^3$.

9. The segmental flow-control method for the flow-control filter string according to claim 8, wherein the anti-channeling flow pack-off particles comprise macromolecular polymer particles having an average particle diameter of 0.1-0.5 mm and a true particle density of 0.94-1.06 g/cm$^3$.

10. The segmental flow-control method for the flow-control filter string according to claim 8, wherein the anti-channeling flow pack-off particles comprise high-density polyethylene particles having an average particle diameter of 0.1-0.5 mm and a true particle density of 0.90-0.98 g/cm$^3$.

11. The segmental flow-control method for the flow-control filter string according to claim 8, wherein the anti-channeling flow pack-off particles comprise polypropylene and polyvinyl chloride macromolecular polymer particles having an average particle diameter of 0.05-1.0 mm and a true particle density of 0.8-1.2 g/cm$^3$.

12. The segmental flow-control method for the flow-control filter string according to claim 1, wherein the anti-channeling flow pack-off particles comprise styrene divinylbenzene crosslink copolymer particles having an average particle diameter of 0.05-1.0 mm and a true particle density of 0.96-1.06 g/cm$^3$.

13. An oil-gas well structure, comprising:

a well wall, a casing located inside the well wall, a cement sheath provided between the casing and the well wall, and a channeling path existing outside the casing;

wherein a plurality of perforated tunnels pass through the casing, the cement sheath and the channeling path and into a formation from the inside of the casing to the formation;

the flow-control filter string is run into the casing, the flow-control filter string is provided with flow-control filters, and an annular space between the flow-control filter string and the casing as well as the channeling path outside the casing are filled with the anti-channeling flow pack-off particles; and the anti-channeling flow pack-off particles fully stuff the annular space and the channeling path.

14. The oil-gas well structure according to claim 13, wherein the anti-channeling flow pack-off particles are carried by a particle-carrying liquid into the annular space and the channeling path, and a true particle density of the anti-channeling flow pack-off particles is close to a density of the particle-carrying liquid so that the anti-channeling flow pack-off particles are adapted to be carried by the particle-carrying liquid into the channeling path.

15. The oil-gas well structure according to claim 14, wherein the true particle density of the anti-channeling flow pack-off particles is any value in a range of 0.4 g/cm$^3$ greater than or less than the density of the particle-carrying liquid.

16. The oil-gas well structure according to claim 15, wherein the true particle density of the anti-channeling flow pack-off particles is any value in a range of 0.2 g/cm$^3$ greater than or less than the density of the particle-carrying liquid.

17. The oil-gas well structure according to claim 13, wherein the anti-channeling flow pack-off particles are carried into the annular space and the channeling path by water or aqueous solution as the particle-carrying liquid.

18. The oil-gas well structure according to claim 13, wherein the anti-channeling flow pack-off particles comprise macromolecular polymer particles having an average particle diameter of 0.05-1.0 mm and a true particle density of 0.8-1.4 g/cm$^3$.

19. The oil-gas well structure according to claim 18, wherein the anti-channeling flow pack-off particles comprise macromolecular polymer particles having an average particle diameter of 0.1-0.5 mm and a true particle density of 0.94-1.06 g/cm$^3$.

20. The oil-gas well structure according to claim 18, wherein the anti-channeling flow pack-off particles comprise high-density polyethylene particles having an average particle diameter of 0.1-0.5 mm and a true particle density of 0.90-0.98 g/cm$^3$.

21. The oil-gas well structure according to claim 18, wherein the anti-channeling flow pack-off particles comprise polypropylene and polyvinyl chloride macromolecular polymer particles having an average particle diameter of 0.05-1.0 mm and a true particle density of 0.8-1.2 g/cm$^3$.

22. The oil-gas well structure according to claim 13, wherein the anti-channeling flow pack-off particles comprise styrene divinylbenzene crosslink copolymer particles having an average particle diameter of 0.05-1.0 mm and a true particle density of 0.96-1.06 g/cm$^3$.

23. A segmental flow-control method for a flow-control filter string in an oil-gas well with a channeling path existing outside a casing, wherein the oil-gas well with the channeling path existing outside the casing comprises a well wall of the oil-gas well, a casing being already run into the oil-gas well, a cement sheath being provided between the casing and the well wall, and the channeling path being a channeling flow passage formed by a vacancy not filled with cement outside the casing, wherein a plurality of perforated tunnels pass through the casing, the cement sheath and the channeling path and into a formation from the inside of the casing to the formation;

the segmental flow-control method for the flow-control filter string includes the following steps:

1) running the flow-control filter string into the casing by means of a run-in string, wherein the flow-control filter string is provided with a flow-control filter, and an annular space is formed between the flow-control filter string and the casing;

2) injecting the particle-carrying liquid carrying the anti-channeling flow pack-off particles into the annular space between the flow-control filter string and the casing; the particle-carrying liquid carries the anti-channeling flow pack-off particles into the annular space between the flow-control filter string and the casing, and into the channeling path outside the casing via the perforated tunnels; and the anti-channeling flow pack-off particles fill, accumulate in and fully stuff the annular space between the flow-control filter string and the casing as well as the channeling path outside the casing;

3) sealing the annular space between the upper portion of the flow-control filter string and the casing;

4) disconnecting the run-in string connected to the flow-control filter string, thereby forming a completion well structure wherein both the annular space between the flow-control filter string and the casing and the channeling path outside the casing are fully stuffed with the anti-channeling flow pack-off particles.

24. The segmental flow-control method for the flow-control filter string in the oil-gas well with the channeling path existing outside the casing according to claim 23, wherein the particle-carrying liquid carrying the anti-channeling flow pack-off particles is water or aqueous solution.

25. The segmental flow-control method for the flow-control filter string in the oil-gas well with the channeling path existing outside the casing according to claim 23, wherein the anti-channeling flow pack-off particles comprise macromolecular polymer particles having an average particle diameter of 0.05-1.0 mm and a true particle density of 0.8-1.4 g/cm$^3$.

26. The segmental flow-control method for the flow-control filter string in the oil-gas well with the channeling path existing outside the casing according to claim 25, wherein the anti-channeling flow pack-off particles comprise macromolecular polymer particles having an average particle diameter of 0.1-0.5 mm and a true particle density of 0.94-1.06 g/cm$^3$.

27. The segmental flow-control method for the flow-control filter string in the oil-gas well with the channeling path existing outside the casing according to claim 25, wherein the anti-channeling flow pack-off particles comprise high-density polyethylene particles having an average particle diameter of 0.1-0.5 mm and a true particle density of 0.90-0.98 g/cm$^3$.

28. The segmental flow-control method for the flow-control filter string in the oil-gas well with the channeling path existing outside the casing according to claim 25, wherein the anti-channeling flow pack-off particles comprise polypropylene and polyvinyl chloride macromolecular polymer particles having an average particle diameter of 0.05-1.0 mm and a true particle density of 0.8-1.2 g/cm$^3$.

29. The segmental flow-control method for the flow-control filter string in the oil-gas well with the channeling path existing outside the casing according to claim 23, wherein the anti-channeling flow pack-off particles comprise styrene divinylbenzene crosslink copolymer particles having an average particle diameter of 0.05-1.0 mm and a true particle density of 0.96-1.06 g/cm$^3$.

* * * * *